United States Patent [19]

Christian

[11] Patent Number: 4,815,353

[45] Date of Patent: Mar. 28, 1989

[54] PHOTONIC PICKUP FOR MUSICAL INSTRUMENT

[76] Inventor: Donald J. Christian, 1222 Dumont, Richardson, Tex. 75080

[21] Appl. No.: 235,836

[22] Filed: Aug. 18, 1988

Related U.S. Application Data

[63] Continuation of Ser. No. 58,646, Jun. 5, 1987, abandoned, which is a continuation of Ser. No. 699,156, Feb. 7, 1985, abandoned.

[51] Int. Cl.[4] ..... G10H 3/18

[52] U.S. Cl. ..... 84/1.16; 84/1.18

[58] Field of Search ..... 84/1.04, 1.14, 1.16, 84/1.18

[56] References Cited

U.S. PATENT DOCUMENTS

| | | | |
|---|---|---|---|
| 2,933,967 | 4/1960 | Riscol . | |
| 3,038,363 | 6/1962 | Miessner . | |
| 3,194,870 | 7/1965 | Tondreau . | |
| 3,514,522 | 5/1970 | Mussulman . | |
| 3,733,953 | 5/1973 | Ferber | 84/1.16 |
| 4,028,977 | 6/1977 | Ryeczek . | |
| 4,182,213 | 1/1980 | Iodice . | |
| 4,320,662 | 3/1982 | Schaub et al. | 364/518 X |
| 4,468,999 | 9/1984 | Bonanno | 84/1.18 |
| 4,563,931 | 1/1986 | Siebeneiker et al. | 84/1.18 |

*Primary Examiner*—Stanley J. Witkowski

*Attorney, Agent, or Firm*—Ross, Howison, Clapp & Korn

[57] ABSTRACT

A photoelectric transducer is provided for musical instruments to pick up musical tones so that they may be amplified, transcribed, resynthesized, or recorded. A light source, such as a light emitting diode, is mounted on the instrument to direct light onto a vibratory element of the instrument. Vibrations of the vibratory element cause modulations in the intensity of the light which is reflected or partially obstructed before reaching a photodetector. The modulated electrical output of the photodetector corresponds to the vibration frequency of the vibratory element and may be amplified to drive a loudspeaker or processed for transcription or resynthesis.

1 Claim, 2 Drawing Sheets

PHOTONIC PICKUP FOR MUSICAL INSTRUMENT

This application is a continuation of application Ser. No. 58,646 filed June 5, 1987 and now abandoned which is a continuation of application Ser. No. 699,156 filed Feb. 7, 1985 and now abandoned.

TECHNICAL FIELD

This invention relates to the electrical amplification of sounds from musical instruments, and more particularly to an optoelectronic device which is responsive to variations in light intensity caused by a vibratory element of the musical instrument.

BACKGROUND OF THE INVENTION

A popular practice in contemporary music is to provide sound amplification systems for musical instruments by using electromechanical transducers. The transducers convert some portion of the instrument's mechanical energy, such as that in a vibrating string, into an electrical signal which is amplified and used to drive a loudspeaker. There are two principal types of musical transducers, or pickups, in common use: magnetic pickups and piezoelectric pickups. Both of these types of pickups have inherent limitations and undesirable characteristics which affect the quality of the amplified sound.

Piezoelectric pickups respond to pressure and must be in mechanical contact with the instrument. Musical tones are communicated to the pickup via the mechanical contact. An undesirable characteristic of piezoelectric pickups is that ambient noise, as well as vibration and shock from handling of the instrument, is also picked up and amplified. Another limitation of such piezoelectric pickups is that the sound produced by the instrument cannot be separated into its constituent tones or voices. The piezoelectric transducer only picks up the complete or composite sound from the instrument and amplifies the one, total signal. In addition, piezoelectric pickups do not respond well to low frequencies and they suffer from an irregular frequency response.

The use of magnetic pickups requires that the instrument's vibratory elements, whether strings, bars, or reeds, be made of magnetically permeable materials. An undesirable characteristic of magnetic pickups is clearly that these vibratory elements must be conductive surfaces which can be a potential electric shock hazard to the musician who must be in contact with them. In addition, the induction coils typically used in magnetic pickups are sensitive to hum and ambient electrical noise and have an undesirable resonance in their frequency response.

Modern technology has made it possible to use a standard polyphonic musical instrument to control a multi-channel musical synthesizer. Another recent development is the possibility of automatic musical score transcription, such as direct transcription from musical performance to printed manuscript. Any electromechanical transducer used for these purposes must provide independent output channels for each string or musical tone source. The channels must have very high isolation and independence to be effective for these purposes. Because these requirements have been very difficult and expensive to accomplish using the traditional technologies of magnetic and piezoelectric transducers, a need has arisen for a new type of transducer.

Many of the inherent limitations of magnetic and piezoelectric pickups have been eliminated by the development of optoelectric pickups for musical instruments. These devices, however, have been limited to string instruments and have suffered from the adverse effects of ambient light from sources such as stage lights and spot lights used during musical performances. Therefore, a need exists for an optoelectrical pickup for musical instruments, other than just string instruments, which is insensitive to ambient light; which is small, lightweight, and adaptable to many different instruments; and which overcomes the problems of magnetic and piezoelectric pickups.

SUMMARY OF THE INVENTION

The present invention comprises a photoelectric, or photonic, apparatus for transducing or picking up musical instrument tones so that they may be transcribed, amplified, resynthesized, or recorded.

The present invention includes a light source mounted on a musical instrument so that the light source directs a light beam on the vibratory element of the instrument, whether this element be a string, a reed, a bar, or a stretched surface. A photodetector is mounted on the instrument so that the photodetector receives light from the light source after its intensity has been modulated by the vibratory element. In the reflective embodiment of the present invention, light is reflected by the vibratory element to the detector. In the interruptive embodiment of the present invention, light is at least partially interrupted by the vibratory element before striking the detector. The vibratory element thus causes variations in the intensity of the light received by the photodetector. Because the modulation of the light is directly related to the frequency of the sound produced by the vibratory element, the output of the photodetector can be amplified and recorded or used to drive a loudspeaker.

The use of photonic pickups on musical instruments provides improved hum and noise rejection and improved frequency response compared to magnetic and piezoelectric transducers. A principal advantage of the photonic pickup is that it can be used with non-ferrous and non-magnetic musical instruments, such as clarinets and classical guitars. Because the photonic pickup eliminates the necessity of the musician contacting metal exposed to an electromagnetic field, the hazard of receiving an electric shock is eliminated.

The photonic pickup of the present invention is mounted totally on the musical instrument and is of such small size and weight that it does not interfere with the musician or the instrument. Once mounted, the device is self-aligning and needs no further adjustment. The photonic pickup is also relatively insensitive to outside interference such as mechanical shock; audible, electromagnetic, or electrostatic noise; and movement of the musician. In addition, the use of an infrared light source and detector improves the reflecting or shadowing effects of the vibratory surface and allows rejection of visible ambient light, thereby optimizing the signal-to-noise performance of the transducer.

For instruments having a plurality of vibratory elements, such as guitar strings, a plurality of light source and photodetector pairs can be provided, one pair for each vibratory element. In this manner each tone of a polyphonic musical instrument can be isolated and amplified independently of the others. This characteristic of the photonic pickup system permits state-of-the-art applications such as the automatic transcription of musical performances and the control of music synthesizers.

BRIEF DESCRIPTION OF THE DRAWINGS

For a more complete understanding of the present invention and for further advantages thereof, reference is now made to the following Description of the Preferred Embodiments taken in conjunction with the accompanying Drawings, in which.

DESCRIPTION OF THE PREFERRED EMBODIMENTS

Figure 1:
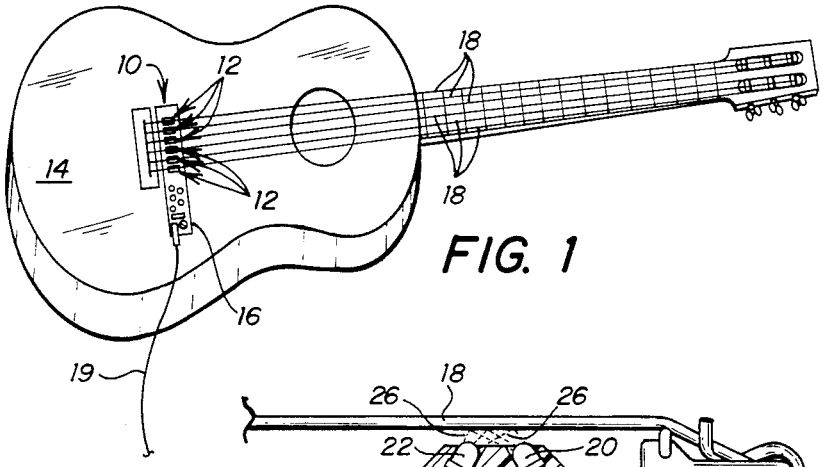
FIG. 1 illustrates a string instrument upon which the reflective embodiment of the present invention is mounted.

Referring to FIG. 1, an embodiment of the present photonic pickup, generally identified by the numeral 10, is illustrated. Photonic pickup 10 includes a plurality of light source and photodetector pairs, generally identified by the numeral 12, mounted on a musical instrument 14. The photonic pickup 10 includes an adjustable support frame 16 which attaches to the musical instrument 14 and holds the source/detector pairs 12.

The musical instrument 14 has a plurality of vibratory elements, such as strings 18. Each source/detector pair 12 is positioned so that the vibratory motion of an associated string 18 causes an analogous modulation of the intensity of the light reflected by string 18 to the detector of the source/detector pair 12. A separate source/detector pair 12 is provided for each vibratory element of the musical instrument 14. Source/detector pair 12 produces an electrical output corresponding to the vibration of a string 18 which can be amplified and applied to loudspeakers or to musical transcription or resynthesis devices. A connecting cable 19 provides the biasing voltage for photonic pickup 10 and transmits the output signal from the source/detector pairs 12 to a loudspeaker or other device.

Although musical instrument 14 has been illustrated as being a guitar, it is understood that the present invention can be used with any type of string instrument.

Figure 2:
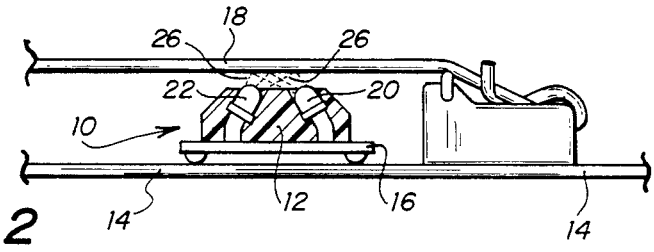
FIG. 2 illustrates a detailed side view of a single light source/photodetector pair and its relationship to one string of the instrument shown in FIG. 1.
Figure 3:
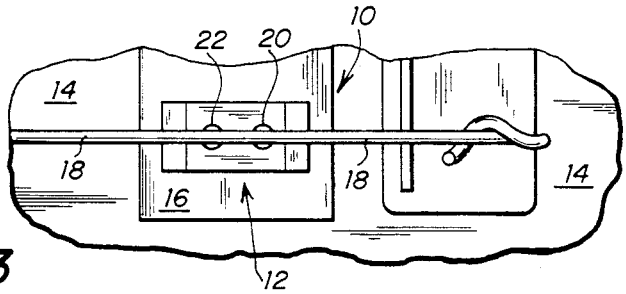
FIG. 3 illustrates a top view of the light source/-photodetector pair shown in FIG. 2.

Referring simultaneously to FIGS. 2 and 3, the position of source/detector pair 12 with respect to a string 18 in the reflective embodiment of the present invention shown in FIG. 1 is illustrated. The support frame 16 of the photonic pickup 10 is mounted on the surface of the musical instrument 14 and mounts the source/detector pair 12 below the string 18. The source/detector pair 12 includes a light source 20, which may comprise, for example, a solid state light emitting diode (LED) or infrared light emitting diode, and a photodetector 22, which may comprise, for example, a phototransistor or photodiode. The source/detector pair 12 is positioned so that a light beam, graphically shown by rays 26, emitted from light source 20 is reflected by string 18 and received by photodetector 22. As string 18 vibrates, the angles of light incidence and reflection vary, causing variations in the intensity of the light received by the photodetector 22. Because of the photoelectric properties of photodetector 22, a modulated electrical output signal is generated which corresponds to the vibration frequency of the string 18.

Figure 4:
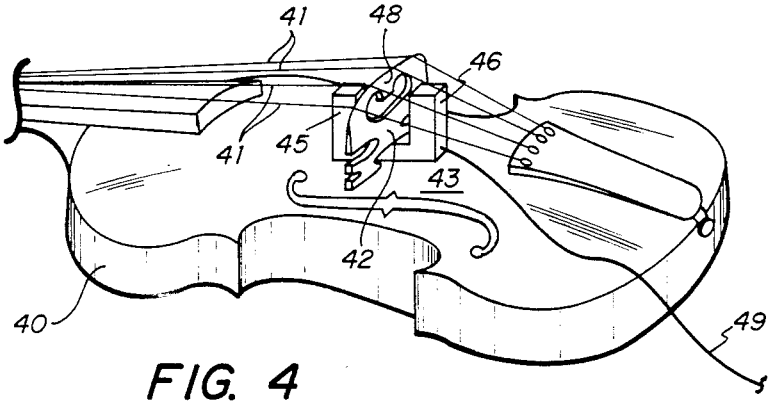
FIG. 4 illustrates the interruptive embodiment of the present invention mounted in conjunction with the bridge of a string instrument.

Referring now to FIG. 4, a stringed musical instrument 40 upon which is mounted an interruptive embodiment of the present invention is illustrated. The vibratory elements, such as strings 41, are suspended by a bridge 42. Vibrations induced in strings 41 by the musician are mechanically communicated through the bridge 42 to the top plate 43 of the stringed musical instrument 40. Top plate 43 acts as a sounding board. Light emitted by light source 45 is partially obstructed by a protrusion 48 of bridge 42. Vibrations of protrusion 48 produce modulations in the intensity of the light received by photodetector 46 positioned opposite light source 45. Photodetector 46 produces a modulated electrical output signal which corresponds to the vibration frequency of bridge 42. Connecting cable 49 provides the biasing voltage for light source 45 and photodetector 46, and transmits the output signal from photodetector 46.

Figure 5:
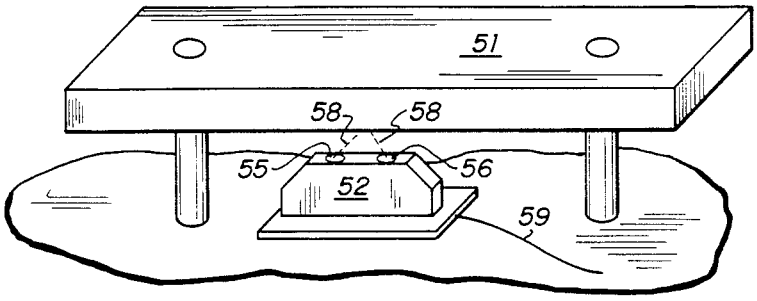
FIG. 5 illustrates a bar of a percussion instrument and one light source/photodetector pair of the reflective embodiment of the present invention.

Referring now to FIG. 5, a bar 51 of a percussion musical instrument, such as a xylophone, fitted with a reflective embodiment of the present photonic pickup, generally identified by the numeral 52 is illustrated. Light emitted by light source 55 is reflected by bar 51 and received by photodetector 56. The path of the light is illustrated by rays 58. Bar 51 vibrates when struck by the musician, modulating the angle of the reflected light and thus the intensity of the light received by photodetector 56. The biasing voltage and the output of photodetector 56, which corresponds to the vibration frequency of bar 51, are carried by cable 59.

Figure 6:
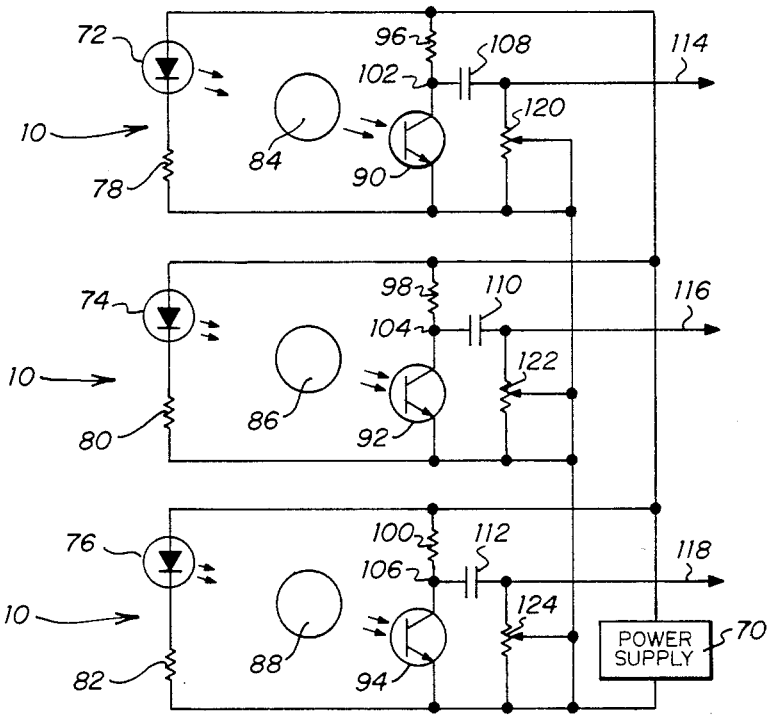
FIG. 6 is an electrical schematic diagram of a three-channel embodiment of the present invention.

Referring now to FIG. 6, an electrical schematic diagram of a three-channel photonic pickup 10 of the present invention is shown. Electromotive power in the form of direct current is supplied by a power source 70. Current flows through the parallel circuits formed by light emitting diodes 72, 74, and 76 and limiting resistors 78, 80, and 82. Diodes 72, 74, and 76 correspond with light source 20 (FIG. 2). Light generated by light emitting diodes 72, 74, and 76 strikes vibratory elements 84, 86, and 88, respectively, which reflect or partially obstruct the light before it is received by photodetectors 90, 92, and 94, respectively. Photodetectors 90, 92, and 94 correspond with photodetector 22 (FIG. 2).

Current also flows through isolation resistors 96, 98, and 100, biasing photodetectors 90, 92, and 94. Changes in the intensity of light striking photodetectors 90, 92, and 94 causes changes in their conductivity which modulates the electrical potential at junctions 102, 104, and 106, respectively. Decoupling capacitors 108, 110, and 112 allow only the time-varying components of the electrical potential at junctions 102, 104, and 106, respectively, to pass to outputs on signal lines 114, 116, and 118, respectively. Potentiometers 120, 122, and 124 are connected to power source 70 and the output signal lines 114, 116, and 118, respectively, to provide adjustment to accommodate variations in parameters such as reflectivity or opacity of the vibratory elements 84, 86, and 88, and sensitivity of photodetectors 90, 92, and 94.

The output on signal line 114 corresponds to the vibrations of vibratory element 84, and is not modulated by the other vibratory elements 86 and 88, and is independent of the output on signal lines 116 and 118 of the other channels. Thus, each tone source of the musical instrument is independently transduced, and each output signal can be independently processed, transcribed, or resynthesized.

It therefore can be seen that the present invention provides for a photonic pickup for use with a variety of musical instruments and which overcomes deficiencies in previously developed magnetic and piezoelectric pickups.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A photonic pickup for a musical instrument having a plurality of vibratable strings for producing musical sounds to be supplied to an output device, comprising:

a plurality of infrared light sources, each of said infrared light sources being mounted on the musical instrument for directing an infrared light beam having a predetermined frequency on one of said plurality of strings, one of said infrared light sources corresponding to one of said strings;

a plurality of infrared photodetectors, each of said infrared photodetectors being mounted on the musical instrument for receiving infrared light, each of said infrared photodetectors corresponding to one of said strings and a corresponding one of said infrared light sources;

a plurality of output signal lines, one of said output signal lines being connected to one of said plurality of infrared photodetectors and the output device;

said plurality of photodetectors being sensitive to said predetermined frequency of said infrared light beam for generating a plurality of modular electrical output signals, one output signal for each output signal line, wherein each of said modulated electrical output signals corresponds to vibrations of only one of said plurality of strings and is generated on only one of said plurality of output signal lines;

a plurality of potentiometers, one of said potentiometers being connected to one of said plurality of photodetectors for matching the sensitivity of each of said photodetectors to said predetermined frequency and for accomodating variations in the reflectivity and opacity of each of the plurality of strings misalignment of the strings with said photodetectors and said light sources.

* * * * *